US006354718B1

(12) United States Patent
Iwaki et al.

(10) Patent No.: US 6,354,718 B1
(45) Date of Patent: Mar. 12, 2002

(54) VEHICULAR HEADLAMP HAVING IMPROVED LOW-BEAM LIGHT DISTRIBUTION PATTERN

(75) Inventors: Takayuki Iwaki; Kenichi Takada, both of Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 09/573,842

(22) Filed: May 19, 2000

(30) Foreign Application Priority Data

May 27, 1999 (JP) ..... 11-147782

(51) Int. Cl.[7] ..... F21V 11/00

(52) U.S. Cl. ..... 362/351; 362/303; 362/343; 362/522; 362/529; 362/539; 362/523; 362/518

(58) Field of Search ..... 362/351, 303, 362/343, 522, 529, 539, 523, 518

(56) References Cited

U.S. PATENT DOCUMENTS 4,740,875 A * 4/1988 Wyckoff ..... 362/336
5,195,815 A * 3/1993 Watanabe ..... 362/539
5,432,685 A 7/1995 Taksukawa et al. ..... 362/61
5,450,295 A 9/1995 Nino ..... 362/346
6,168,297 B1 * 1/2001 Tatsukawa ..... 362/351

* cited by examiner

*Primary Examiner*—Sandra O'Shea
*Assistant Examiner*—Ali Alavi
(74) *Attorney, Agent, or Firm*—Sughrue Mion, PLLC

(57) ABSTRACT

A vehicular headlamp utilizing a light source bulb of the H4 type and which provides a low-beam light distribution pattern which makes it easy for the driver to drive and reduces the possibility of oncoming drivers being dazzled by glare. A light source bulb is securely supported by a reflector so that left and right upper edges of a shade are located at substantially the same height and an axis of a filament is upwardly offset from an optical axis of the reflector at a predetermined angle. A reflecting surface of the reflector is provided with a downward deflective reflection zone which downwardly deflects and reflects the light that has traveled from the filament past the right upper edge of the shade and impinged on a traveling-lane-side reflection zone. Thereby a low-beam light distribution pattern is obtained wherein an oncoming-lane-side horizontal cut-off line formed of light reflected from the traveling-lane-side reflection zone is at a lower level than a traveling-lane-side horizontal cut-off line formed of light reflected from an oncoming-lane-side reflection zone.

12 Claims, 10 Drawing Sheets

VEHICULAR HEADLAMP HAVING IMPROVED LOW-BEAM LIGHT DISTRIBUTION PATTERN

FIELD OF THE INVENTION

The present invention relates to a vehicular headlamp having a light source bulb of the "H4" type.

BACKGROUND OF THE INVENTION

Many conventional vehicular headlamps employ a low-beam light distribution pattern P' as shown in FIG. 10, which has a horizontal cut-off line CL1' and a diagonal cut-off line CL2' rising from the horizontal cut-off line CL1' at an angle of 15°. In this low-beam light distribution pattern P', the horizontal cut-off line CL1' is arranged on the side of the oncoming lane and the diagonal cut-off line CL2' is arranged on the side of the is lane in which the vehicle is traveling, whereby forward visibility for the driver is ensured while preventing the vision of drivers of oncoming vehicles from being dazzled by glare.

To obtain such a low-beam light distribution pattern, a light source bulb of the H4 type is often employed, which has a longitudinally extending filament 18*a* and a shade 18*c* covering the filament 18*a* around its axis at a central angle of approximately 165° so that light beams emitted from the filament 18*a* in the downward direction are blocked. Due to the light-blocking effect of the shade 18*c*, light from the filament 18*a* does not impinge on a lower zone of a reflecting surface indicated by broken lines in FIG. 10.

In a vehicular headlamp designed to obtain the low-beam light distribution pattern described above, vertical aiming (beam adjustment) is carried out in the low-beam mode of the headlamp with respect to the horizontal cut-off line CL1'. For this reason, the contrast in luminosity of the horizontal cut-off line CL1' should be sufficiently enhanced.

However, if the contrast in luminosity of the horizontal cut-off line CL1' is enhanced excessively, long-distance visibility tends to decrease to such an extent that the driver may experience difficulty in driving in situations where the road ahead suddenly becomes dark, for example, in a case where the vehicle is approaching a flat road at the end of the descent of a slope. Also, even if the horizontal cut-off line CL1' is slightly displaced upwards or downwards due to pitching of the vehicle or the like, there is a concern that oncoming drivers could be dazzled by glare.

SUMMARY OF THE INVENTION

The present invention has been made in consideration of such circumstances. It is an object of the present invention to provide a vehicular headlamp employing an H4 type light source bulb and which is capable of providing a low-beam light distribution pattern which makes it easy for a driver to drive and reduces the possibility of oncoming drivers being dazzled by glare.

The present invention achieves the above-stated object by the provision of an improved structure for securely supporting a light source bulb on a reflector, and by providing the reflector or a front lens with a suitable downward deflective reflection zone or a downward deflective transmission zone.

More specifically, a vehicular headlamp according to a first aspect of the present invention includes a light source bulb having a longitudinally extending filament and a shade covering the filament around its longitudinal axis at a central angle of approximately 165° so that light traveling downward from the filament is blocked, a reflector securely supporting the light source bulb and having a reflecting surface forwardly reflecting light from the filament, and a front lens disposed forwardly of the reflector. The light source bulb is securely supported by the reflector so that left and right upper edges of the shade are at substantially the same height and the longitudinal axis of the filament is offset upward from the optical axis of the reflector at a predetermined angle. The reflecting surface of the reflector is provided with a downward deflective reflection zone which deflects downward and reflects light that has traveled from the filament past the vicinity of the upper edges of the shade and impinges on a traveling-lane-side reflection zone of the reflecting surface.

A vehicular headlamp according to a second aspect of the present invention includes a light source bulb having a longitudinally extending filament and a shade covering the filament around its axis at a central angle of approximately 165° so that light beam traveling downward from the filament is blocked, a reflector securely supporting the light source bulb and having a reflecting surface forwardly reflecting light beam from the filament, and a front lens disposed forwardly of the reflector. The light source bulb is securely supported by the reflector so that left and right upper edges of the shade are at substantially the same height and the longitudinal axis of the filament is offset upward from the optical axis of the reflector at a predetermined angle. The front lens is provided with a downward deflective transmission zone which downwardly deflects and transmits light that has traveled from the filament past the vicinity of the upper edges of the shade and impinges on a traveling-lane-side reflection zone of the reflecting surface.

The aforementioned "predetermined angle" means an angle is required to transform a generally sectorial light distribution pattern formed of light beams reflected from the reflecting surface of the reflector to a pattern where a pair of left and right cut-off lines constituting upper edges of the pattern at a central angle of approximately 195° are both substantially horizontal, under the condition that the reflecting surface is a paraboloid of revolution extending around the optical axis of the reflector.

In the above-described vehicular headlamp of the present invention which has the light source bulb securely supported by the reflector so that the left and right upper edges of the shade are located at substantially the same height and that the longitudinal axis of the filament is offset upward from the optical axis of the reflector at the predetermined angle, under the condition that the reflecting surface of the reflector is a paraboloid of revolution extending around the optical axis of the reflector, a low-beam light distribution pattern is obtained which has horizontal cut-off lines formed of light beams reflected from the reflecting surface on laterally opposed sides of a vertical line perpendicular to the reference axis of the lighting fixture, hereinafter referred to as "line V".

In addition, with the reflecting surface of the reflector provided with the downward deflective reflection zone which downwardly deflects and reflects light that has traveled from the filament past the vicinity of the upper edges of the shade and impinges on the traveling-lane-side reflection zone of the reflecting surface, the front lens is provided with the downward deflective transmission zone which downwardly deflects and transmits light that has traveled from the filament past the vicinity of the upper edges of the shade and impinges on the traveling-lane-side reflection zone of the reflecting surface. Thus, in the aforementioned low-beam light distribution pattern, the oncoming-lane-side horizontal cut-off line formed of light reflected from the traveling-lane-side reflection zone is at a lower level than the traveling-lane-side horizontal cut-off line formed of light reflected from the oncoming-lane-side reflection zone.

In such a low-beam light distribution pattern, since vertical aiming can be carried out with respect to the traveling-lane-side horizontal cut-off line, the contrast in luminosity of the oncoming-lane-side horizontal cut-off line can be reduced.

This prevents long-distance visibility from being reduced when the road ahead of the vehicle suddenly darkens, for example, when the vehicle approaches a flat road after having traveled down a slope. As long as the horizontal cut-off line is just slightly displaced upward or downward due to pitching of the vehicle or the like, the luminosity of the upward light beams can be prevented from reaching a high level. Hence, the possibility of oncoming drivers being dazzled by glare is reduced.

In this manner, in a vehicular headlamp having a light source bulb of H4 bulb type, the present invention makes it possible to obtain a low-beam light distribution pattern which makes the vehicle easy to drive and reduces the possibility of oncoming drivers being dazzled by glare.

Moreover, since vertical aiming can be carried out with respect to the traveling-lane-side horizontal cut-off line as described above, it is also possible to set the target aiming position to a position where the horizontal cut-off line coincides with a horizontal line perpendicular to the lighting fixture reference axis, hereinafter referred to as "line H". By thus setting the target position, even without the use of special equipment for carrying out an aiming measurement, it becomes possible to carry out vertical aiming by means of a simple operation of making the traveling-lane-side horizontal cut-off line coincide with the height of the lighting fixture reference axis above ground level in a low-beam light distribution pattern directed onto a wall surface or the like in front of the vehicle.

As to the first aspect of the present invention, if the downward deflective reflection zone of the reflecting surface of the reflector is composed of a plurality of downward deflective reflecting elements having different downward deflection angles, the contrast in luminosity of the oncoming-lane-side horizontal cut-off line can be reduced sufficiently. Therefore it is possible to more effectively reduce the possibility of oncoming drivers being dazzled by glare.

In accordance with the first aspect of the present invention, if the reflecting surface of the reflector is provided with a horizontally deflective reflection zone which horizontally deflects and reflects light that has traveled from the filament past the vicinity of the upper edges of the shade and impinges on an oncoming-lane-side reflection zone of the reflecting surface, and if the horizontally deflective reflection zone forms a long-distance radiation light distribution pattern wherein oncoming-lane-side ends are substantially located on the line V, the long-distance visibility of the driver can be enhanced.

Further concerning the first aspect of the present invention, although the front lens may be formed of a translucent lens with all the functions of light distribution control allotted to the reflector, a plurality of lens elements may be formed in a predetermined zone of the front lens so that the front lens also performs the function of light distribution control. In the latter case, each of the lens elements may be designed to perform the function of downward deflective transmission or horizontally deflective transmission for compensating for the function of downward deflective reflection or horizontally deflective reflection performed by the reflecting surface of the reflector. Alternatively, each of the lens elements may be designed to exclusively perform another function (e.g., the function of lateral diffusion).

On the other hand, as to the second aspect of the present invention, if the downward deflective transmission zone is composed of a plurality of downward deflection lens elements having different downward deflection angles, the contrast in luminosity of the oncoming-lane-side horizontal cut-off line can be reduced sufficiently. Thus, it is possible to more effectively reduce the possibility of oncoming drivers being dazzled by glare.

Further concerning the second aspect of the present invention, if the front lens is provided with a horizontally deflective transmission zone which horizontally deflects and transmits light that has traveled from the filament past the vicinity of the upper edges of the shade and been reflected by an oncoming-lane-side reflection zone of the reflecting surface, and if the horizontally deflective transmission zone forms a long-distance radiation light distribution pattern wherein oncoming-lane-side ends are substantially located on a line V, the long-distance visibility of the driver can be enhanced.

DESCRIPTION OF THE PREFERRED EMBODIMENTS

Preferred embodiments of the present invention will be described with reference to the drawings.

Figure 1:
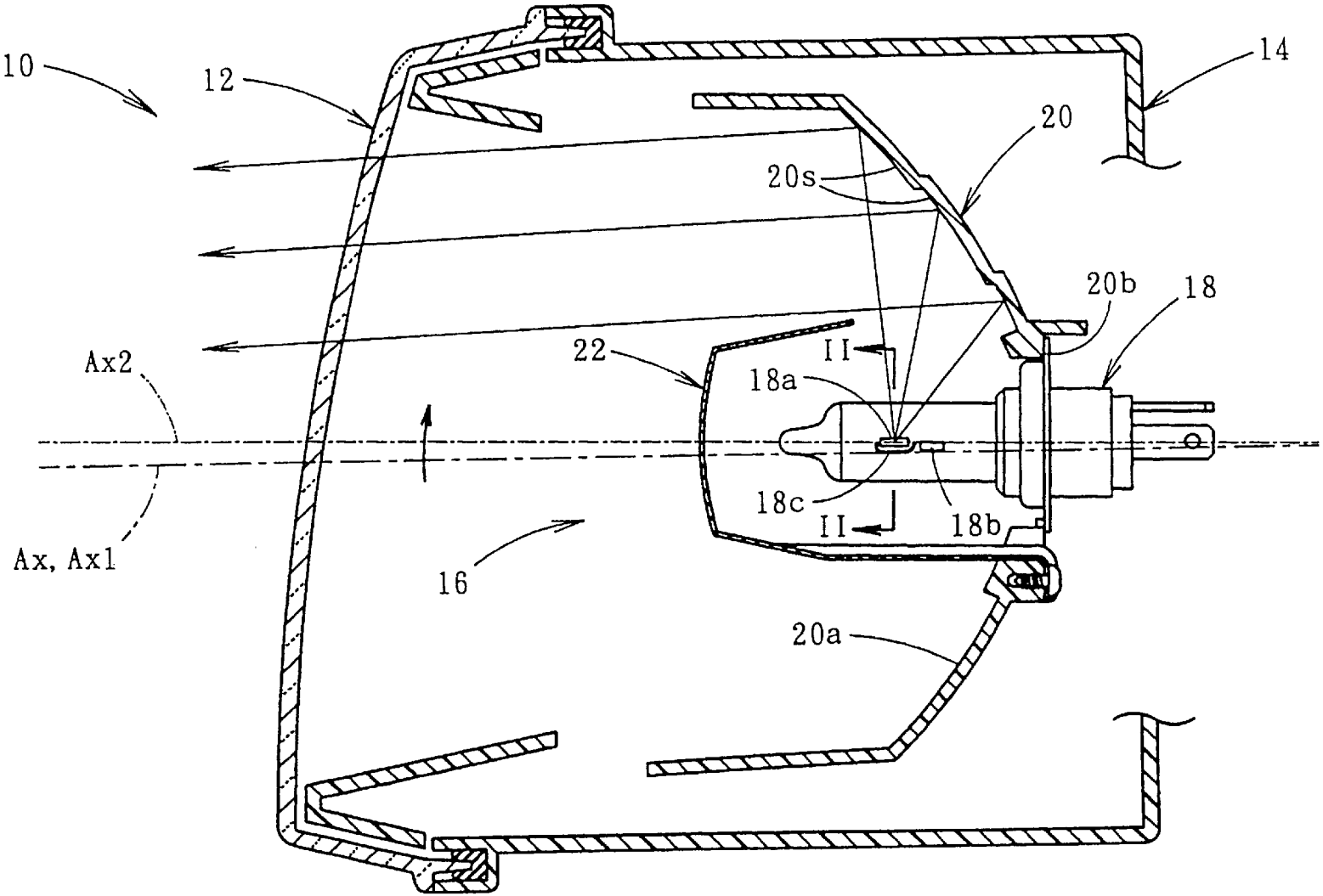
FIG. 1 is a side sectional view of a vehicular headlamp constructed according to a first embodiment of the present invention.
Figure 2:
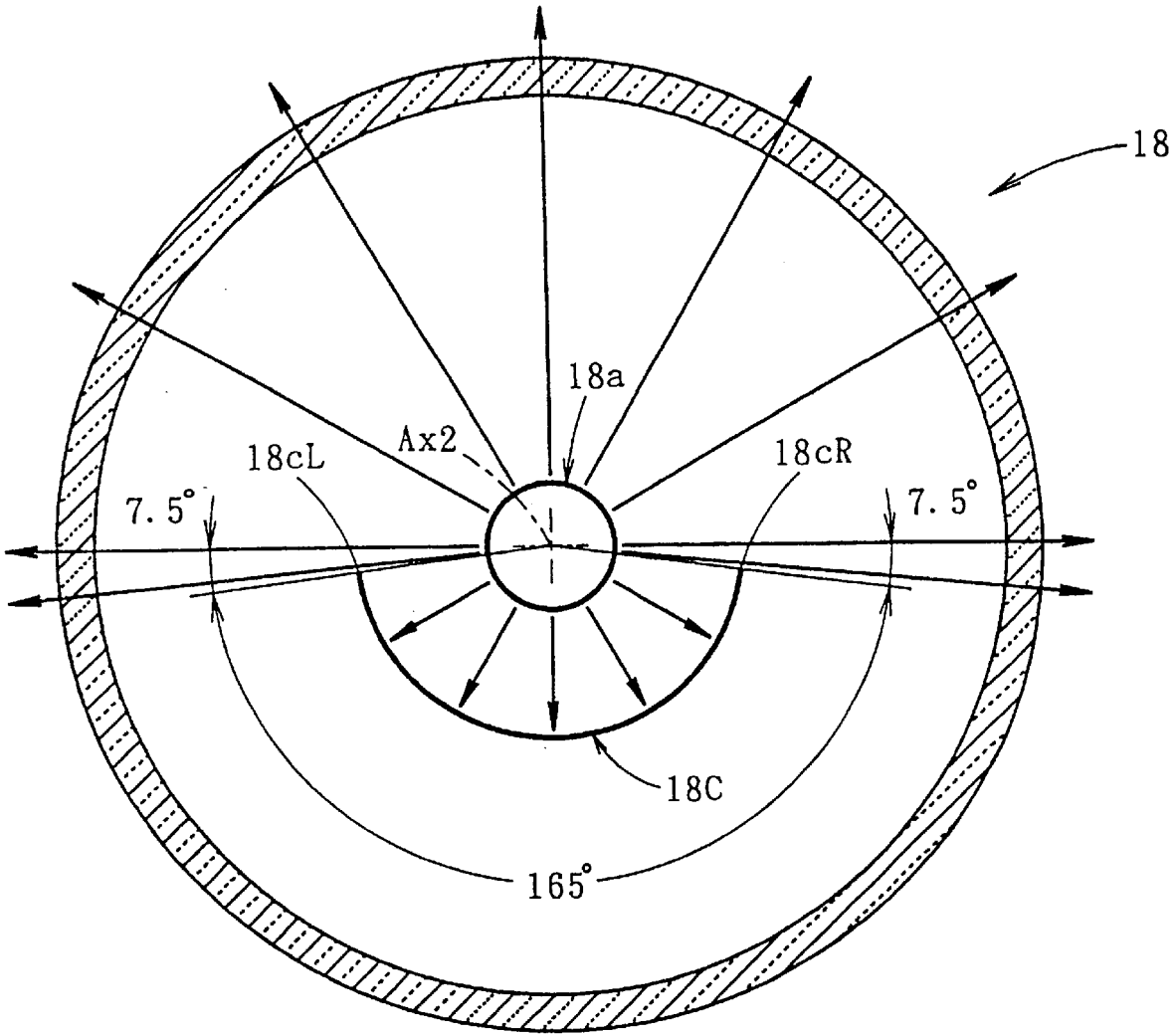
FIG. 2 is a detailed sectional view taken along a line II—II shown in FIG. 1.

FIG. 1 is a side sectional view of a vehicular headlamp 10 constructed according to the first embodiment, and FIG. 2 is a detailed sectional view taken along a line II—II in FIG. 1.

As shown in FIG. 1, the vehicular headlamp 10 of this embodiment has a reflector unit 16 mounted in a lighting chamber formed by a front lens and a lamp body 14 in such as manner as to be vertically and laterally tiltably adjustable.

The reflector unit 16 has a light source bulb 18, a reflector 20 and an outer shade 22. The reflector unit 16 is supported by the lamp body 14 so that the optical axis Ax1 of the reflector 20 substantially coincides with a lighting fixture reference axis Ax (a horizontal line longitudinally extending past a reference 10 position of the lighting fixture).

The light source bulb 18 is an HB2 bulb (a halogen bulb of the H4 type). The light source bulb 18 has two filaments 18*a*, 18*b* which extend longitudinally, and a shade 18*c* which covers the front filament 18*a* at a central angle of approximately 165° is extending around an axis Ax2 of the filament 18*a*. The light source bulb 18 is securely supported by the reflector 20 by attachment to a bulb insertion-attachment portion 20*b* provided at the rear apex of the reflector 20.

The light source bulb 18 is securely supported by the 20 reflector 20 in such a manner that the two upper edges 18*c*L, 18*c*R of the shade 18*c* are at substantially the same height (at left and right angular positions diagonally downward from the axis Ax2 at an angle of approximately 7.5° respectively) as shown in FIG. 2, and that the axis Ax2 is slightly upwardly offset from the optical axis Ax1 of the reflector 20 as shown in FIG. 1. The offsetting of the axis Ax2 is achieved by slantingly forming the bulb insertion-attachment portion 20*b* of the reflector 20.

The reflector 20 has a reflecting surface 20*a* having a plurality of reflecting elements 20*s* formed on a paraboloid of revolution extending around the optical axis Ax1. The reflecting surface 20*a* is designed to diffusively and deflectively reflect light from the filament 18*a* or 18*b* forwardly. When lit, the filament 18*a* forms a low-beam light distribution pattern, while the filament 18*b* when lit forms a high-beam light distribution pattern. The front lens 12 is made of a translucent material.

The outer shade 22, which is disposed in front of the light source bulb 18, is designed to block direct light emanating from the filament 18*a* towards the front of the lighting fixture.

Figure 3:
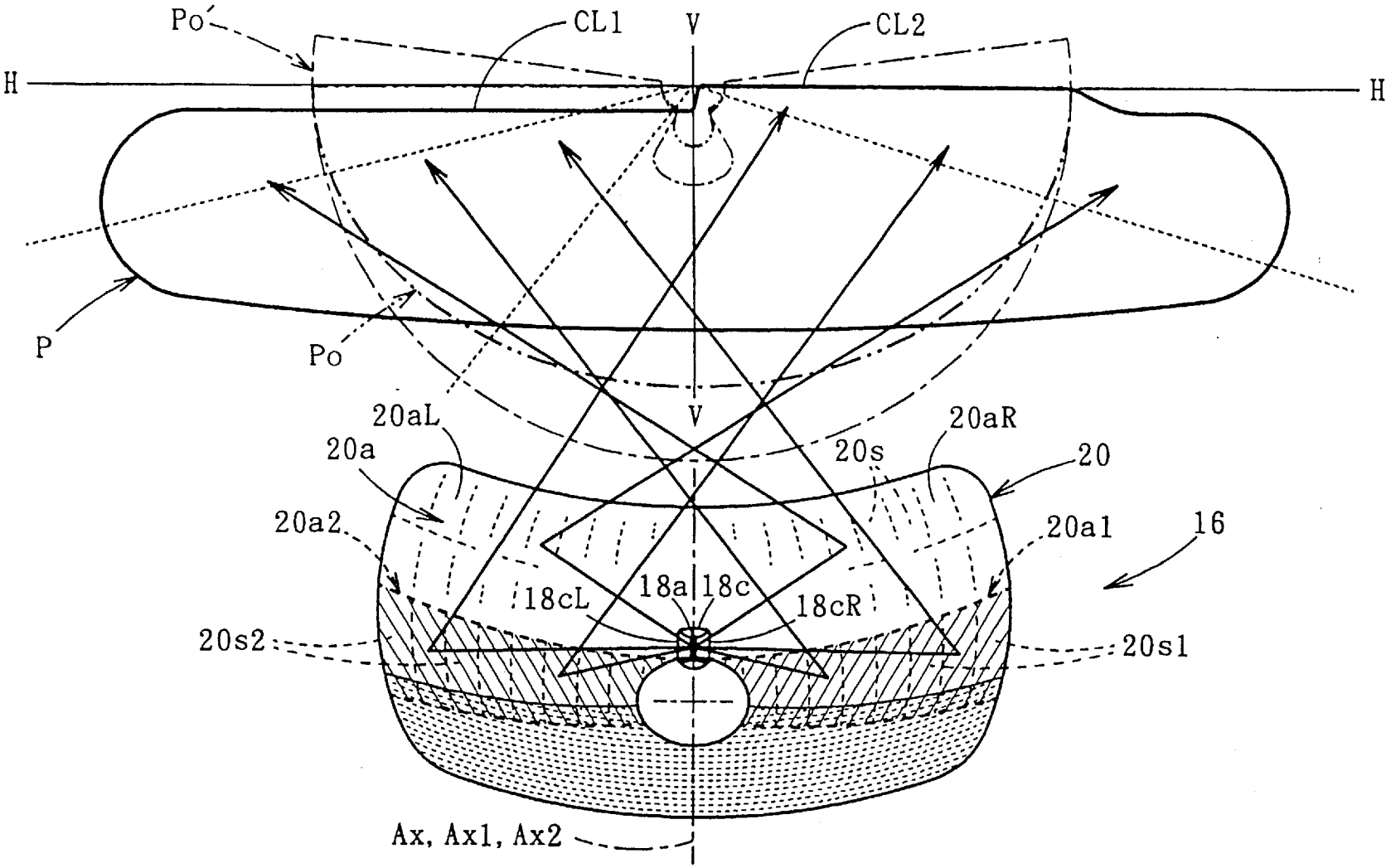
FIG. 3 shows a low-beam light distribution pattern formed by the vehicular headlamp of the first embodiment, together with a reflector unit, in a perspective view seen from the side of a rear surface of the reflector unit.

FIG. 3 shows a low-beam light distribution pattern P formed by the vehicular headlamp 10 together with the reflector unit 16 is in a perspective view seen from the side of the rear surface of the reflector unit 16.

In this embodiment, the upper edges 18*c*L, 18*c*R of the shade 18*c* are at substantially the same height (at respective left and right angular positions diagonally downward from the axis Ax2 at an angle of approximately 7.5°), and the axis Ax2 of the filament 18*a* is slightly upwardly offset from the optical axis Ax1 of the reflector 20. Light from the filament 18*a* impinges on a reflection zone of the reflecting surface 20*a* of the reflector 20. The reflection zone is somewhat larger than the upper half of the reflecting surface 20*a*. Due to the light-blocking effect of the shade 18*c*, light from the filament 18*a* does not impinge on a lower zone of the reflecting surface indicated by broken lines in FIG. 3.

Assuming that the reflecting surface 20*a* is a paraboloid of revolution extending around the optical axis Ax1, the light reflected from the reflecting surface 20*a* forms a basic light distribution pattern Po, which is a generally semicircular and slightly flattened light distribution pattern with its upper edge substantially located on a line H, as indicated by broken long-and-two-short dashed lines in FIG. 3. Referring to FIG. 3, a long-and-short dashed line indicates a generally sectorial light distribution pattern Po' which is obtained for a case where the axis Ax2 of the filament 18*a* is not upwardly offset from the optical axis Ax1 of the reflector 20. The light distribution pattern Po' has left and right upper edges extending diagonally upwardly at an angle of approximately 7.5°.

In this embodiment, the basic light distribution pattern Po is transformed by the diffusive and deflective reflection performed by the reflecting elements 20*s* formed on the reflecting surface 20*a* to the low-beam light distribution pattern P as indicated by a solid line in FIG. 3.

The low-beam light distribution pattern P, which is designed for right-side light distribution, has horizontal cut-off lines CL1 and CL2 which are located at different levels on laterally opposed sides of a line V. The right horizontal cut-off line CL2 is located on the line H and formed directly on the right upper edge of the basic light distribution pattern Po. On the other hand, the left horizontal cut-off line CL1 is located slightly below the line H and is formed by downwardly displacing part of the left upper edge of the basic light distribution pattern Po. To form the left horizontal cut-off line CL1, the reflecting surface 20*a* is provided with a downward deflective reflection zone (a zone with diagonal lines extending upwardly to the right) 20*a*1 which downwardly deflects and reflects the light that has traveled from the filament 18*a* past the vicinity of the right upper edge 18*c*R of the shade 18*c* and impinges on a traveling-lane-side reflection zone 20*a*R of the reflection zone 20*a*.

Figure 4:
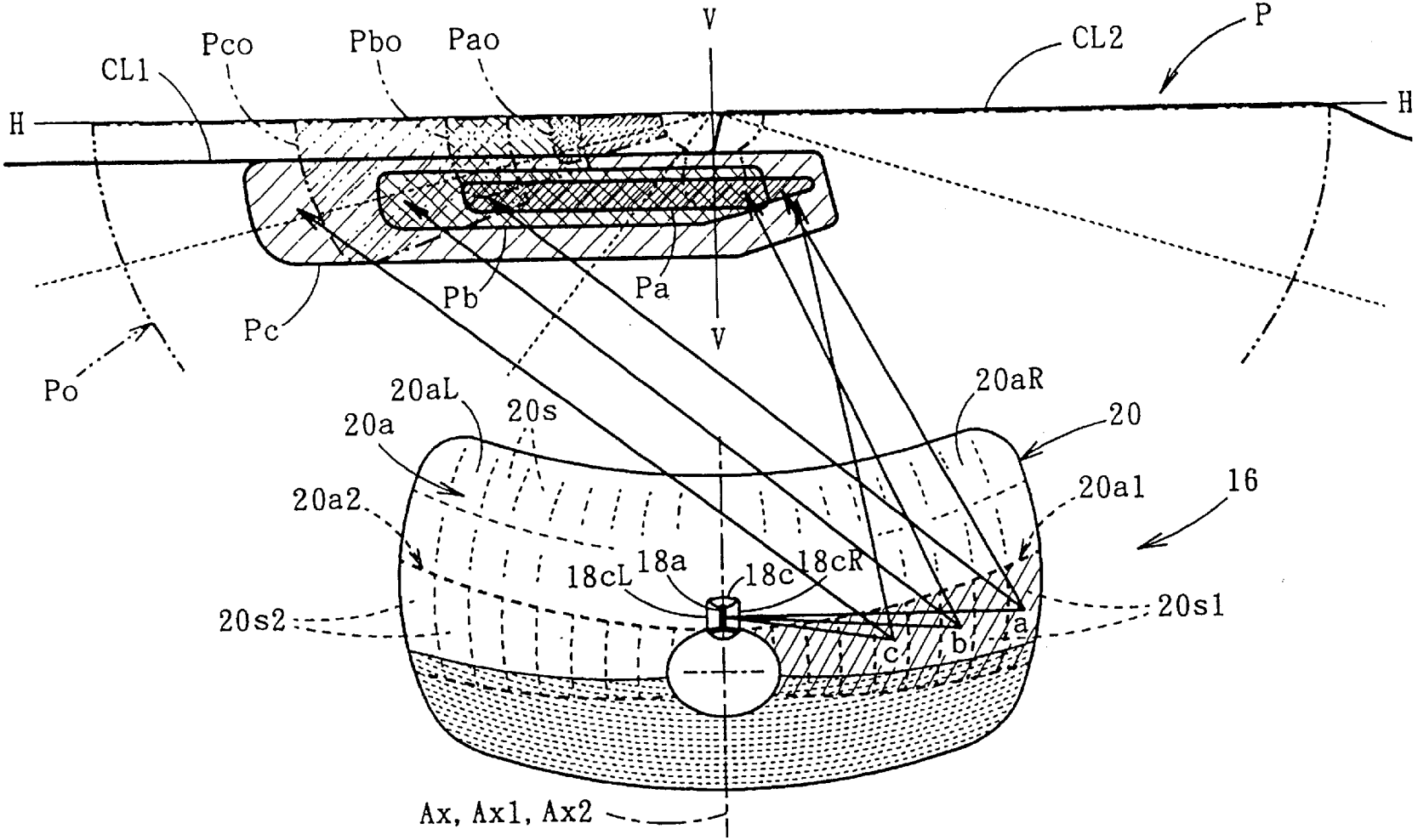
FIG. 4 shows a light distribution pattern formed by a downward deflective reflection zone of the vehicular headlamp of the first embodiment, together with the reflector unit, in a perspective view seen from the side of the rear surface of the reflector unit.

As shown in FIG. 4, a plurality of reflecting elements 20*s*1 (downward deflection reflecting elements) constituting the downward deflective reflection zone 20*a*1 do not form a unique downward deflection angle. Namely, reflecting elements (a) located on the outer peripheral side of the reflecting surface 20*a* form a large angle, reflecting elements (c) located on the inner peripheral side of the reflection zone 20*a* form a small angle, and reflecting elements (b) located therebetween form an intermediate angle. This arrangement serves to form a plurality of segmented light distribution patterns Pa, Pb and Pc having vertically offset upper edges from a plurality of segmented light distribution patterns Pao, Pbo and Pco, respectively, which have upper edges at the same level. With this arrangement, the contrast in luminosity of the horizontal cut-off line CL1 on the side of the oncoming lane is sufficiently reduced.

Figure 5:
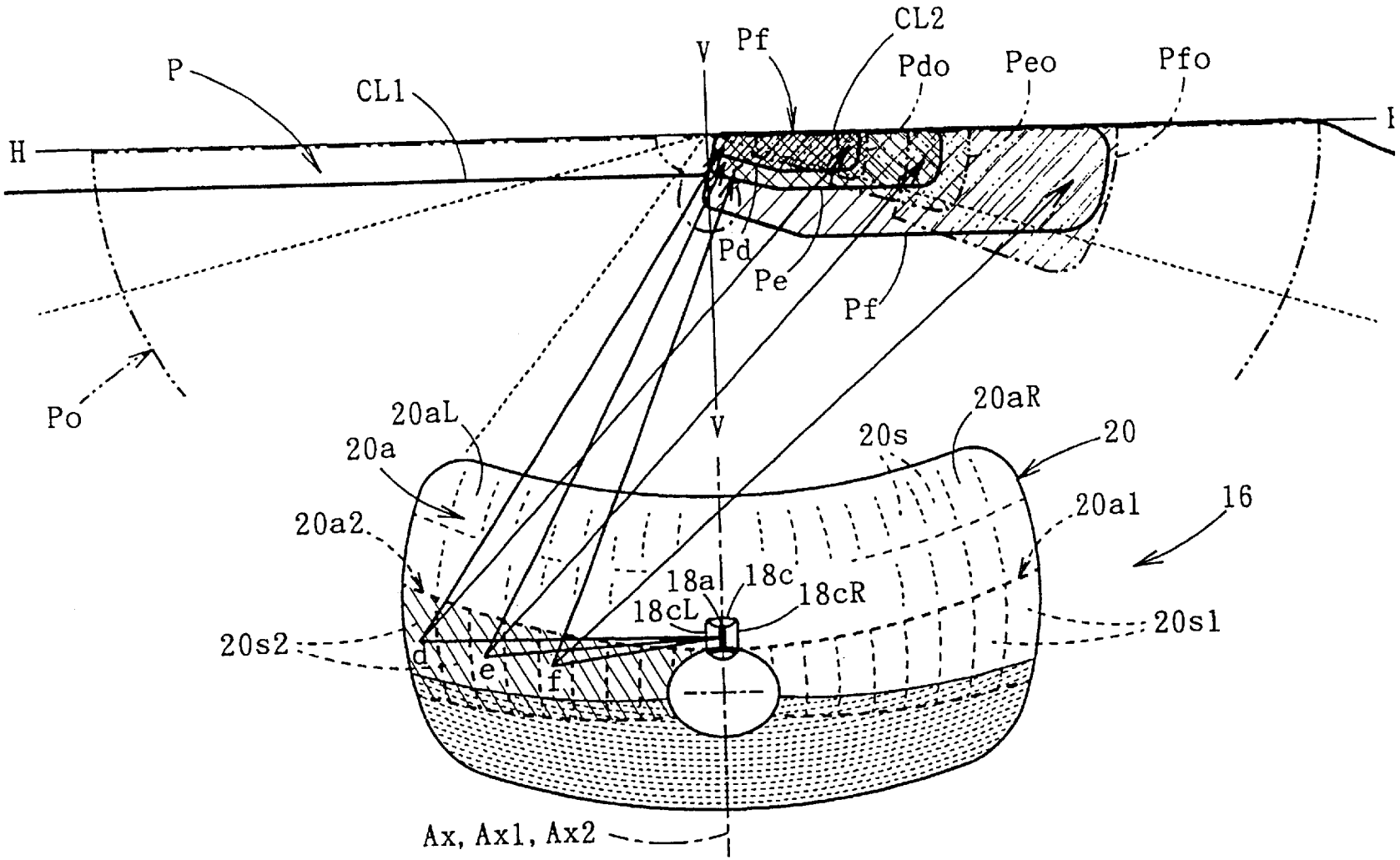
FIG. 5 shows a long-distance radiation light distribution pattern formed by a horizontally deflective reflection zone of the vehicular headlamp of the first embodiment, together with the reflector unit, in a perspective view seen from the side of the rear surface of the reflector unit.

As shown in FIG. 5, the reflecting surface 20*a* is provided with a horizontally deflective reflection zone (a zone with diagonal lines extending upwardly to the left) 20*a*2 which horizontally deflects and reflects the light that has traveled from the filament 18*a* past the vicinity of the left upper edge 18*c*L of the shade 18*c* and impinged on an oncoming-lane-side reflection zone 20*a*L of the reflection zone 20*a*. The horizontally deflective reflection zone 20*a*2 forms a long-distance radiation light distribution Pf whose left end (the end on the side of the oncoming lane) is located substantially on the line V. To realize this, a plurality of reflecting elements 20s2 constituting a horizontally deflective reflection zone 20a2 do not form a unique horizontal deflection angle. Namely, reflecting elements (d) located on the outer peripheral side of the reflecting surface is 20a form a small angle, and reflecting elements (f) located on the inner peripheral side of the reflecting surface 20a form a large angle, and reflecting elements (e) located therebetween form an intermediate angle. This serves to form a plurality of segmented light distribution patterns Pd, Pe and Pf having left ends located substantially on the line V out of a plurality of segmented light distribution patterns Pdo, Peo and Pfo, respectively, which have left ends offset from one another.

As has been described in detail, in the vehicular headlamp 10 of this embodiment the light source bulb 18 is securely supported by the reflector 20 so that the left and right upper edges 18cL, 18cR of the shade 18c are located at the same height and that the axis Ax2 of the filament 18a is upwardly offset from the optical axis Ax1 of the reflector 20 at a predetermined angle. The reflecting surface 20a of the reflector 20 is provided with the downward deflective reflection zone 20a1 which downwardly deflects and reflects the light that has traveled from the filament 18a past the vicinity of the right upper edge 18cR of the shade 18c and impinged on the traveling-lane-side reflection zone 20aR. Accordingly, it is possible to obtain a low-beam light distribution pattern P wherein the oncoming-lane-side horizontal cut-off line CL1 formed of light reflected from the traveling-lane-side reflection zone 20aR is at a lower level than the traveling-lane-side horizontal cut-off line CL2 formed of light beams reflected from the oncoming-lane-side reflection zone 20aL.

Because the low-beam light distribution pattern P makes it possible to carry out vertical aiming with respect to the traveling-lane-side horizontal cut-off line CL2, the contrast in luminosity of the oncoming-lane-side horizontal cut-off line CL1 can be reduced. Thus, the low-beam light distribution pattern P makes it easy for the driver to drive the vehicle while reducing the possibility of oncoming drivers being dazzled by glare.

Moreover, since the downward deflective reflection zone 20a1 is composed of a plurality of reflecting elements 20s1 having different downward deflection angles, the contrast in luminosity of the oncoming-lane-side horizontal cut-off line CL1 can be reduced sufficiently. Thereby it becomes possible to more effectively reduce the possibility of oncoming drivers being dazzled by glare.

In this embodiment, since the light source bulb 18 is offset upwardly, the basic light distribution pattern Po is flattened and made closer in shape to the low-beam light distribution pattern P in comparison with the case where the light source 18 is not upwardly offset. Thus, it is possible to facilitate the diffusive and deflective reflection control of the reflector 20 which is performed to transform the basic light distribution pattern Po into the low-beam light distribution pattern P.

In addition, according to this embodiment, the reflecting surface 20a of the reflector 20 is provided with the horizontally deflective reflection zone 20a2 forming the long-distance radiation light distribution pattern Pf whose left end is substantially located on the line V. With this arrangement it is possible to enhance the long-distance visibility of the driver.

In this embodiment, the target position for vertical aiming is set to a position where the traveling-lane-side horizontal cut-off line CL2 coincides with the line H. Thus, even without special equipment for carrying out aiming measurement, it is possible to effect vertical aiming by means of a simple operation of making the traveling-lane-side horizontal cut-off line CL2 coincide with a height of the lighting fixture reference axis Ax above ground level in the low-beam light distribution pattern P radiated onto a wall surface or the like in front of the vehicle. Moreover, it is also possible to easily carry out lateral aiming if the target position of lateral aiming is set to a position where the left end of the long-distance radiation light distribution pattern Pf substantially coincides with the line V.

Next, a second embodiment of the present invention will be described.

Figure 6:
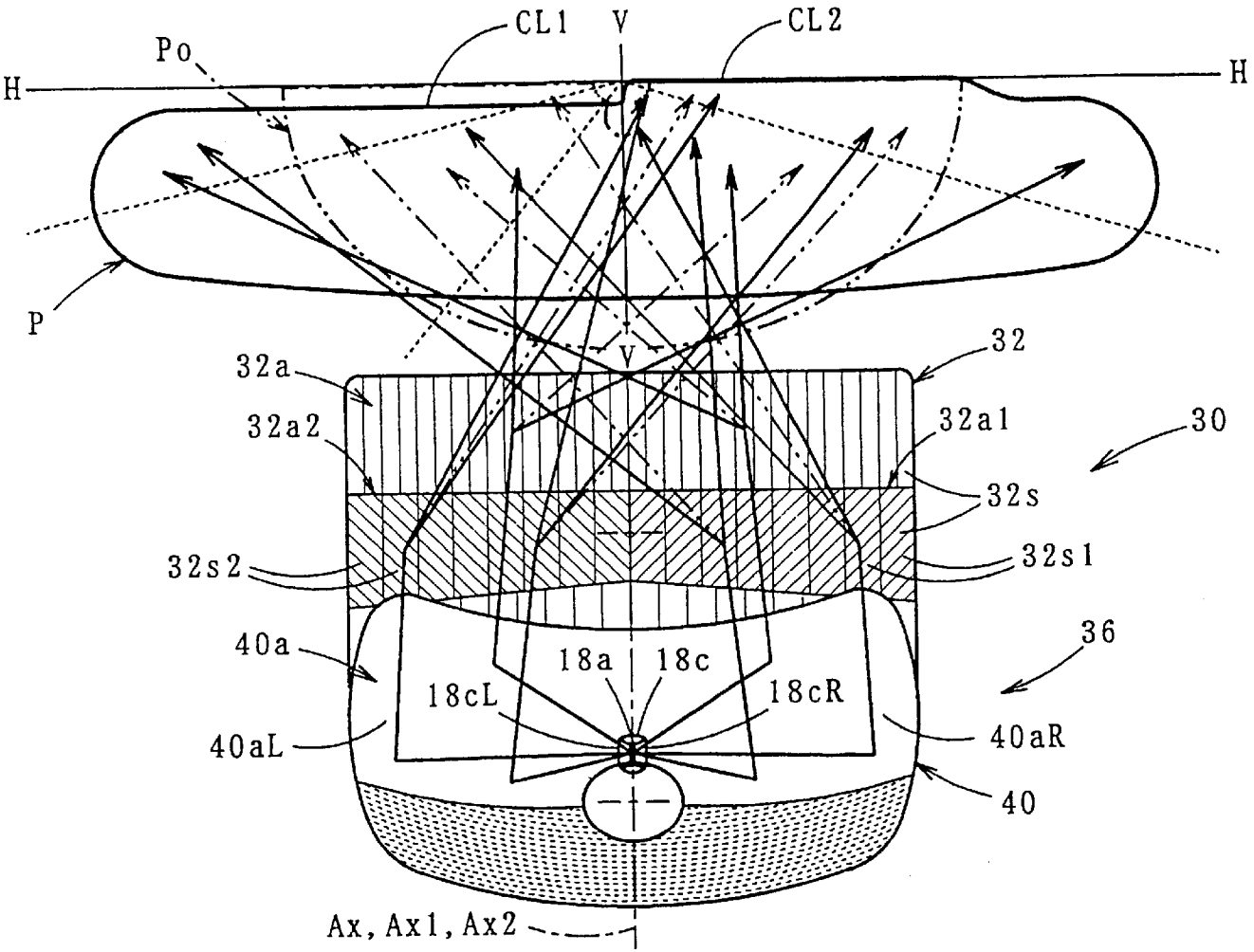
FIG. 6 shows a low-beam light distribution pattern formed by a vehicular headlamp according to a second embodiment of the present invention, together with a front lens and a reflector unit, in a perspective view seen from the side of a rear surface of the reflector unit.

FIG. 6 shows a low-beam light distribution pattern P formed by a vehicular headlamp 30 of the second embodiment, together with a front lens 32 and a reflector unit 36 in a perspective view seen from the side of the rear surface of the reflector unit 36.

The vehicular headlamp 30 of this embodiment is constructed basically in the same manner as that of the first embodiment. However, the second embodiment differs from the first embodiment in the structures of the reflecting surface 40a of a reflector is 40 and the lens surface 32a of the front lens 32.

Namely, in this embodiment, the reflecting surface 40a of the reflector 40 is formed as a paraboloid of revolution extending around the optical axis Ax1 of the reflector 40. The reflecting surface 40a forwardly reflects light from a filament 18a as a generally parallel light beam slightly deflected towards the optical axis Ax, thus forming a basic light distribution pattern Po. The second embodiment is identical to the first embodiment in that the axis Ax2 of the filament 18a is slightly upwardly offset from the optical axis Ax1 of the reflector 40 to form the basic light distribution pattern Po. Due to the light-blocking effect of a shade 18c, light from the filament 18a does not impinge on the lower zone of the reflecting surface indicated by broken lines in FIG. 6.

In this embodiment, a plurality of lens elements 32s are formed on the lens surface 32a of the front lens 32, and the basic light distribution pattern Po is transformed into a low-beam light distribution pattern P by the diffusive and deflective transmission performed by the lens elements 32s. Referring to FIG. 6, long-and-two-short dashed lines indicate extensions of light beams reflected from the reflecting surface 40a, and solid lines indicate light beams diffusively and deflectively transmitted through the lens elements 32s.

The low-beam light distribution pattern P has horizontal cut-off lines CL1, CL2 on laterally opposed sides of a line V. To form the left horizontal cut-off line CL1 at a lower level than the right horizontal cut-off line CL2, the lens surface 32a of the front lens 32 is provided with a downward deflective transmission zone 32a1 which downwardly deflects and transmits light that has traveled from the filament 18a past the right upper edge 18cR of the shade 18c and been reflected by a traveling-lane-side reflection zone 40aR of the reflecting surface 40a.

Figure 7:
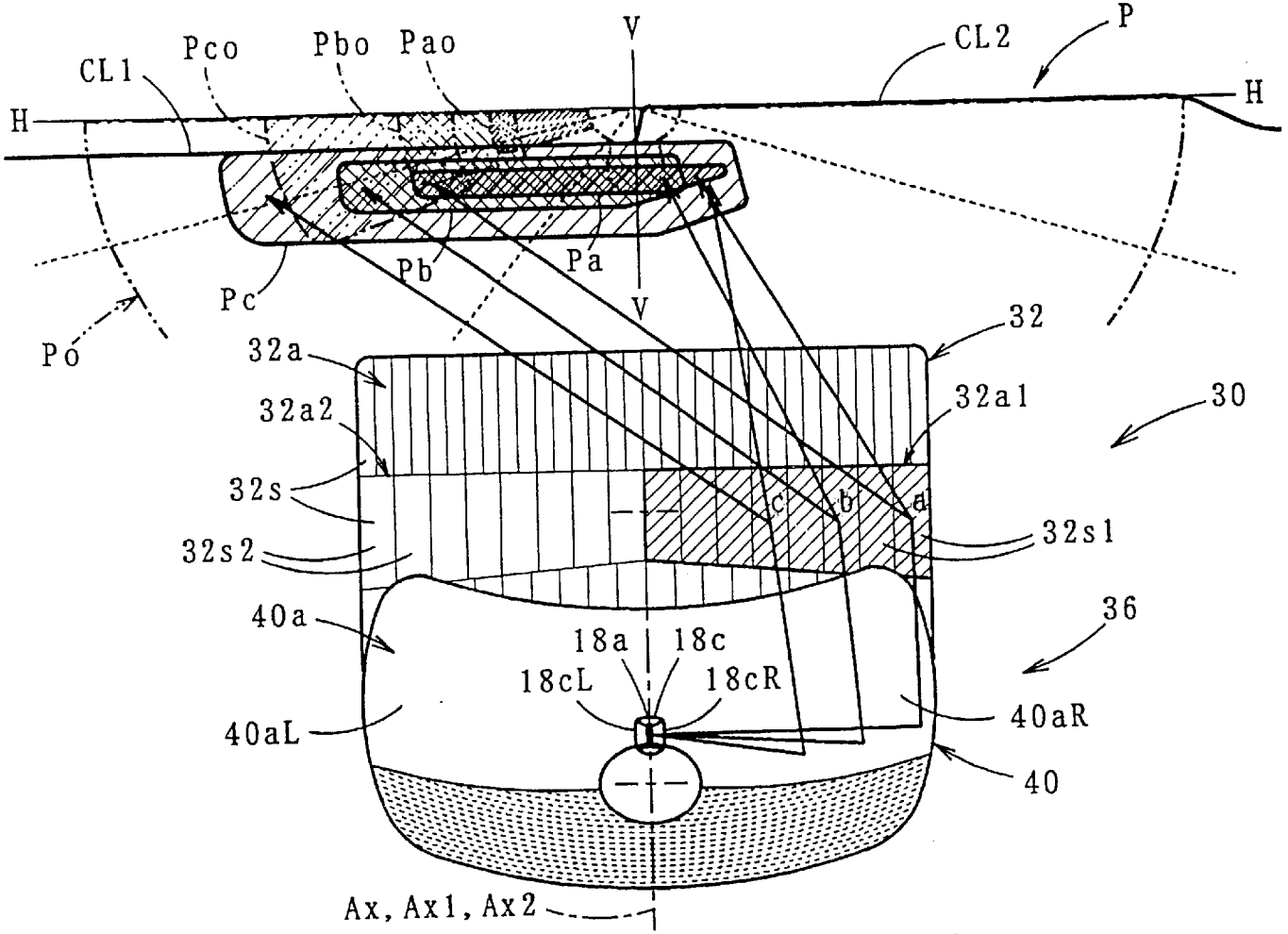
FIG. 7 shows a light distribution pattern formed by a downward deflective transmission zone of the vehicular headlamp of the second embodiment, together with the front lens and the reflector unit, in a perspective view seen from the side of the rear surface of the reflector unit.

As shown in FIG. 7, a plurality of lens elements 32s1 (downward deflective transmission elements) constituting the downward deflective transmission zone (a zone with diagonal lines extending upwardly to the right) 32a1 do not form a unique downward deflection angle. Namely, lens elements (a) located on the outer peripheral side of the reflecting surface 40a form a large angle, lens elements (c) located on the inner peripheral side of the reflecting surface 40a form a small angle, and lens elements (b) located therebetween form an intermediate angle. This serves to form a plurality of segmented light distribution patterns Pa, Pb and Pc having vertically offset upper edges out of a plurality of segmented light distribution patterns Pao, Pbo and Pco, respectively, which have upper edges at the same level. Thus, the contrast in luminosity of the horizontal cut-off line CL1 on the side of an oncoming lane is sufficiently reduced.

Figure 8:
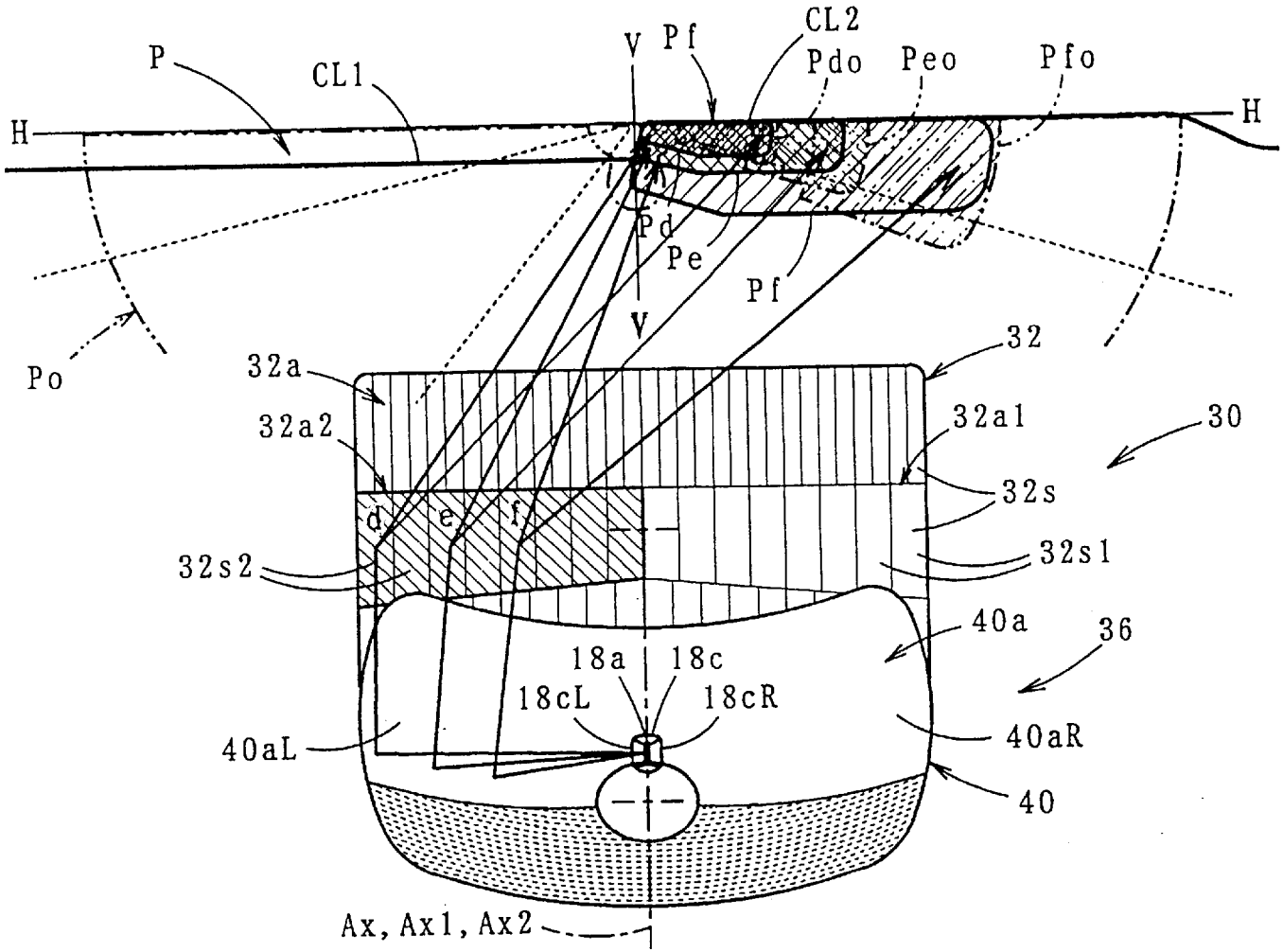
FIG. 8 shows a long-distance radiation light distribution pattern formed by a horizontally deflective transmission zone of the vehicular headlamp of the second embodiment, together with the front lens and the reflector unit, in a perspective view seen from the side of the rear surface of the reflector unit.

As shown in FIG. 8, the lens surface 32*a* of the front lens 32 is provided with a horizontally deflective transmission zone (a zone with diagonal lines extending upwardly to the left) 32*a*2 which horizontally deflects and transmits the light that has traveled from the filament 18*a* past the vicinity of the left upper edge 18*c*L of the shade 18*c* and been reflected by an oncoming-lane-side reflection zone 40*a*L of the reflection zone 40*a*. The horizontally deflective transmission zone 32*a*2 forms a long-distance radiation light distribution Pf whose left end (the end on the side of the oncoming lane) is located substantially on the line V. To realize this, a plurality of lens elements 32*s* constituting a horizontally deflective transmission zone 32*a*2 do not form a unique horizontal deflection angle. Namely, lens elements (d) located on the outer peripheral side of the reflecting surface 40*a* form a small angle, lens elements (f) located on the inner peripheral side of the reflecting surface 40*a* form a large angle, and lens elements (e) located therebetween form an intermediate angle. This serves to form a plurality of segmented light distribution patterns Pd, Pe and Pf having left ends located substantially on the line V out of a plurality of segmented light distribution patterns Pdo, Peo and Pfo, respectively, which have left ends offset from one another.

As has been described in detail, the vehicular headlamp 30 of this embodiment has the light source bulb 18 which is securely supported by the reflector 40 so that the left and right upper edges 18*c*L, 18*c*R of the shade 18*c* are located at the same height and the axis Ax2 of the filament 18*a* is upwardly offset from the optical axis Ax1 of the reflector 40 at a predetermined angle. The reflecting surface 32*a* of the front lens 32 is provided with the downward deflective transmission zone 32*a*1 which downwardly deflects and transmits the light that has traveled from the filament 18*a* past the vicinity of the right upper edge 18*c*R of the shade 18*c* and been reflected by the traveling-lane-side reflection zone 40*a*R. With this construction, it is possible to obtain a low-beam light distribution pattern P wherein the oncoming-lane-side horizontal cut-off line CL1 formed of light reflected from the traveling-lane-side reflection zone 40*a*R is at a lower level than the traveling-lane-side horizontal cut-off line CL2 formed of light reflected from the oncoming-lane-side reflection zone 40*a*L.

Because the low-beam light distribution pattern P makes it possible to easily carry out vertical aiming with respect to the traveling-lane-side horizontal cut-off line CL2, the contrast in luminosity of the oncoming-lane-side horizontal cut-off line CL1 can be reduced. Thus, the low-beam light distribution pattern P can make it easy for the driver to drive and reduce the possibility of oncoming drivers being dazzled by glare.

Moreover, since the downward deflective transmission zone 32*a*1 is composed of a plurality of lens elements 32*s*1 having different downward deflection angles, the contrast in luminosity of the oncoming-lane-side horizontal cut-off line CL1 can be reduced sufficiently. Thereby it becomes possible to more effectively reduce the possibility of oncoming drivers being dazzled by glare.

In this embodiment, since the light source bulb 18 is upwardly offset, the basic light distribution pattern Po is flattened and made closer in shape to the low-beam light distribution pattern P, in comparison with the case where the light source 18 is not upwardly offset. Thus it is possible to facilitate the diffusive and deflective transmission control of the front lens 32 which is performed to transform the basic light distribution pattern Po into the low-beam light distribution pattern P.

In addition, according to this embodiment, the lens surface 32*a* of the front lens 32 is provided with the horizontally deflective transmission zone 32*a*2 forming the long-distance radiation light distribution pattern Pf whose left end is substantially located on the line V. Therefore it is possible to enhance the long-distance visibility of the driver.

In this embodiment, the target position of vertical aiming is set to a position where the traveling-lane-side horizontal cut-off line CL2 coincides with the line H. Thus, even without special equipment for carrying out aiming measurement, it is possible to effect vertical aiming by means of a simple operation of making the traveling-lane-side horizontal cut-off line CL2 coincide with a height of the lighting fixture reference axis Ax above ground level in a low-beam light distribution pattern P radiated onto a wall surface or the like in front of the vehicle. It is also possible to easily carry out lateral aiming if the target position of lateral aiming is set to a position where the left end of the long-distance radiation light distribution pattern Pf substantially coincides with the line V.

Next, a third embodiment of the present invention will be described.

Figure 9:
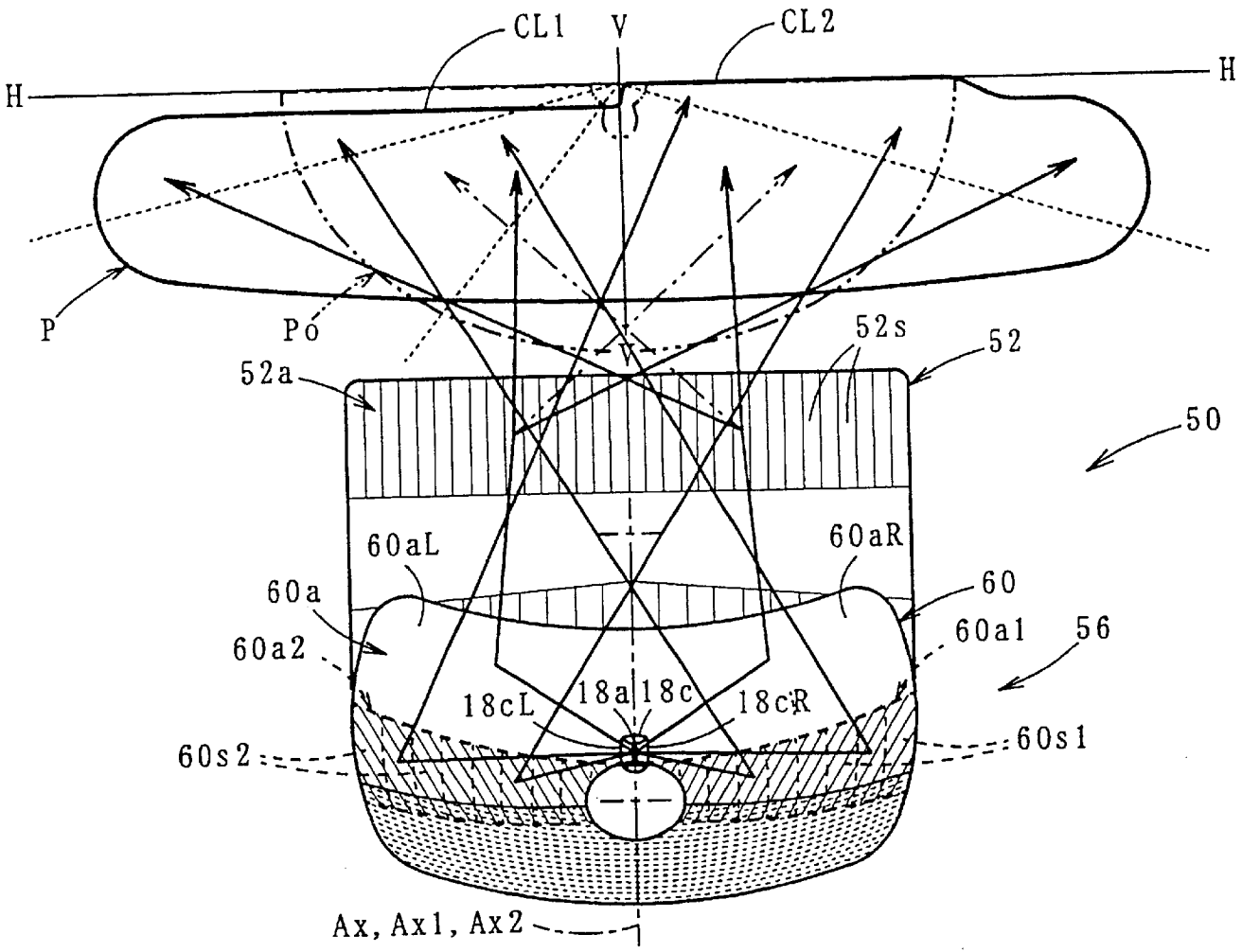
FIG. 9 shows a low-beam light distribution pattern formed by a vehicular headlamp according to a third embodiment of the present invention, together with a front lens and a reflector unit, in a perspective view seen from the side of the rear surface of the reflector unit.
Figure 10:
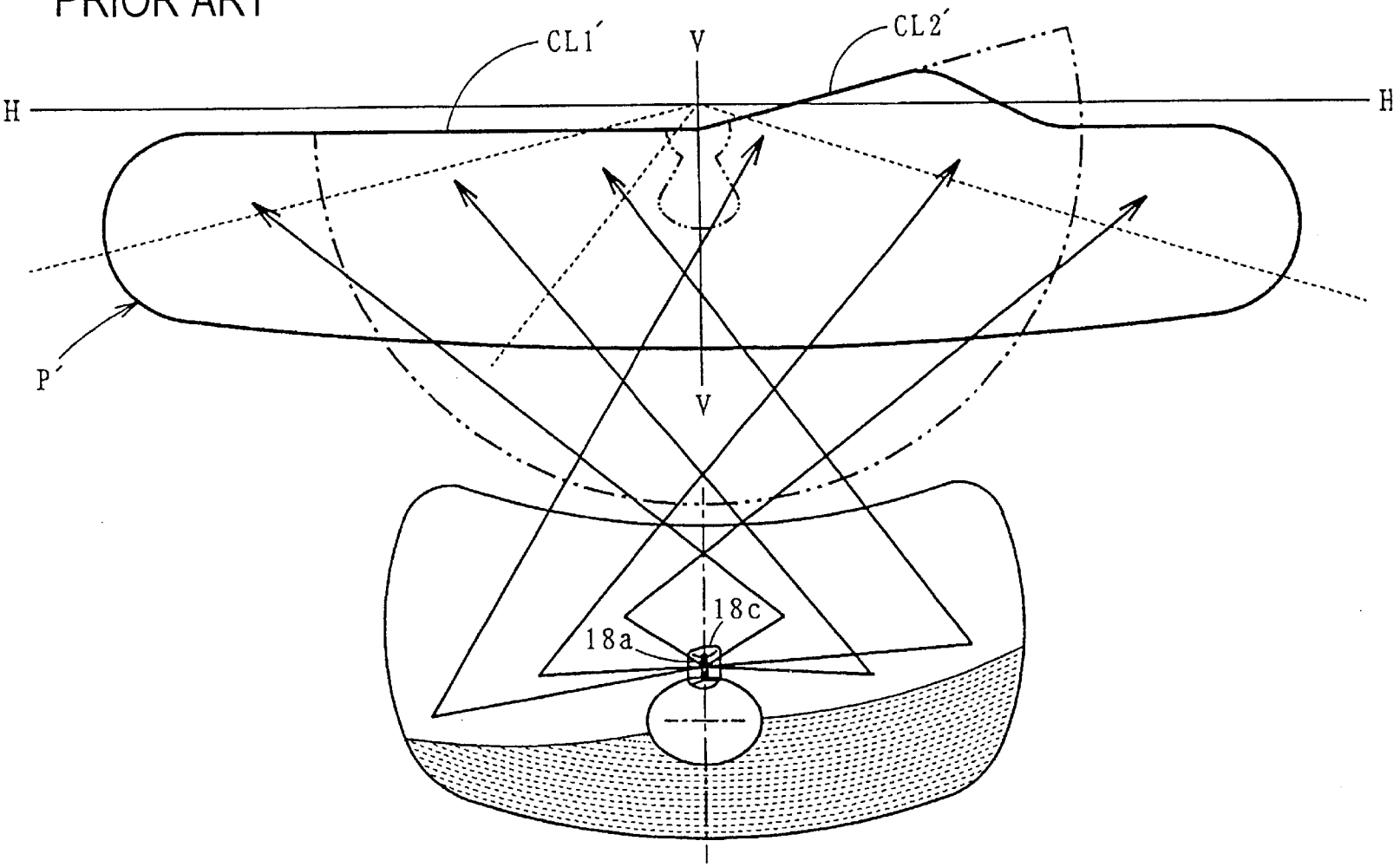
FIG. 10 PRIOR ART
FIG. 10, otherwise similar to FIG. 3, shows a conventional example of a vehicular headlamp.

FIG. 9 shows a low-beam light distribution pattern P formed by a vehicular headlamp 50 of the third embodiment together with a front lens 52 and a reflector unit 56 in a perspective view seen from the side of a rear surface of the reflector unit 56.

The vehicular headlamp 50 of this embodiment is also constructed basically in the same manner as that of the first embodiment. However, the third embodiment is different from the first embodiment in the structures of a reflecting surface 60*a* of a reflector 60 and a lens surface 52*a* of the front lens 52. Namely, in this embodiment, the reflecting surface 60*a* of the reflector 60 is formed as a paraboloid of revolution extending around the optical axis Ax1 of the reflector 60. A downward deflective reflection zone (a zone with diagonal lines extending upwardly to the right) 60*a*1 and a horizontally deflective reflection zone (a zone with diagonal lines extending upwardly to the left) 60*a*2, which are similar to those of the first embodiment, are formed on the paraboloid of revolution. A plurality of reflecting elements 60*s*, 60*s*2, similar to those of the first embodiment, are formed on the downward deflective reflection zone 60*a*1 and the horizontally deflective reflection zone 60*a*2 respectively. A zone in the reflecting surface 60*a* of the reflector 60 above the deflective reflection zones 60*a*1, 60*a*2 is formed as a paraboloid of revolution extending around the optical axis Ax1 of the reflector 60.

The lens 52*a* of the front lens 52 is made of a translucent material in a section in front of the deflective reflection zones 60*a*1, 60*a*2, and has a plurality of lens elements 52*s* in a section in front of the zone above the deflective reflection zones 60*a*1, 60*a*2.

This embodiment is also designed such that the axis Ax2 of the filament 18*a* is slightly upwardly offset from the optical axis Ax1 of the reflector 60 to form a basic light distribution pattern Po. Due to the light-blocking effect of the shade 18*c*, light from the filament 18*a* does not impinge on a lower zone of the reflecting surface indicated by broken lines in FIG. 9.

In this embodiment, the basic light distribution pattern P is transformed by the function of diffusive and deflective reflection performed by a plurality of reflecting elements 60*s*1, 60*s*2 formed on the reflecting surface 60*a* of the reflector 60 and the function of diffusive and deflective transmission performed by a plurality of lens elements 52*s* formed on the lens surface 52*a* of the front lens 52, whereby the low-beam light distribution pattern P as indicated by a solid line in FIG. 9 is formed. In this process, a long-distance light distribution pattern extending along horizontal cut-off lines CL1, CL2 is formed by the function of diffusive and deflective reflection performed by the reflector 60, whereas a light distribution pattern short thereof is formed by the function of diffusive and deflective transmission performed by the front lens 52.

As has been described in detail, this embodiment also makes it possible to obtain the low-beam light distribution pattern P wherein the oncoming-lane-side horizontal cut-off line CL1 formed of light beams reflected from a traveling-lane-side reflection zone 60*a*R is at a lower level than the traveling-lane-side horizontal cut-off line CL2 formed of light reflected from an oncoming-lane-side reflection zone 40*a*L.

Accordingly, this embodiment also makes it possible to achieve an operation and effects similar to those of the first and second embodiments. Moreover, since the lens surface 52*a* of the front lens 52 of this embodiment is made up of the section formed of the translucent lens and the section formed of the lens elements 52*s*, the three-dimensional design of the lighting fixture can be readily carried out. In particular, since the lens elements 52*s* are formed in the upper zone of the lens surface 52*a*, the lighting chamber can be prevented from becoming easily visible from viewing points in front of the lighting fixture.

Although the horizontal cut-off lines CL1, CL2 in this embodiment are formed by the function of diffusive and deflective reflection performed by the reflector 60, it is also possible to form the horizontal cut-off lines CL1, CL2 by adding the function of diffusive and deflective transmission to the functions performed by the front lens 52.

Although the description of the aforementioned embodiments has been made with reference to a lighting fixture structure in which a low-beam light distribution pattern P for right-side light distribution is obtained, it is possible to obtain a low-beam light distribution pattern for left-side light distribution, which is laterally symmetrical to the low-beam light distribution pattern P, by laterally inverting the lighting fixture structure of the aforementioned embodiments. In such a case, an operation and effects similar to those of the aforementioned embodiments can be achieved.

It should further be apparent to those skilled in the art that various changes in form and detail of the invention as shown and described above may be made. It is intended that such changes be included within the spirit and scope of the claims appended hereto.

What is claimed is:

1. A vehicular headlamp comprising:

a light source bulb comprising a longitudinally extending filament and a shade covering a bottom area of the filament around a longitudinal axis of said filament at a central angle of approximately 165° so that light downwardly travelling from said filament is blocked by said shade;

a reflector supporting said light source bulb and having a reflecting surface forwardly reflecting light from said filament, said light source bulb being supported by said reflector so that left and right upper edges of said shade are at substantially the same height and so that said longitudinal axis of said filament is upwardly offset from an optical axis of said reflector at a predetermined angle;

a front lens disposed forward of said reflector; and means for downwardly deflecting light that has traveled from said filament past the upper edges of said shade and impinged on a traveling-lane-side reflection zone of said reflecting surface.

2. A vehicular headlamp comprising:

a light source bulb comprising a longitudinally extending filament and a shade covering a bottom area of the filament around a longitudinal axis of said filament at a central angle of approximately 165° so that the light downwardly travelling from said filament is blocked by said shade;

a reflector supporting said light source bulb and having a reflecting surface forwardly reflecting light from said filament; and a front lens disposed forward of said reflector, said light source bulb being supported by said reflector so that left and right upper edges of said shade are at substantially the same height and so that said longitudinal axis of said filament is upwardly offset from an optical axis of said reflector at a predetermined angle; and said reflecting surface of the reflector being provided with a downward deflective reflection zone which downwardly deflects and reflects light that has traveled from said filament past the upper edges of said shade and impinged on a traveling-land-side reflection zone of said reflecting surface.

3. The vehicular headlamp according to claim 2, wherein: said downward deflective reflection zone comprises a plurality of downward deflection reflecting elements having respective different downward deflection angles.

4. The vehicular headlamp according to claim 2, wherein said reflecting surface of said reflector is provided with a horizontally deflective reflection zone which horizontally deflects and reflects light that has traveled from said filament past upper edges of said shade and impinged on an oncoming-lane-side reflection zone of said reflecting surface; and wherein said horizontally deflective reflection zone forms a long-distance radiation light distribution pattern wherein oncoming-lane-side ends are located substantially on a vertical line perpendicular to a lighting fixture reference axis.

5. The vehicular headlamp according to claim 2, wherein a plurality of lens elements are formed in a predetermined zone of said front lens.

6. The vehicular headlamp according to claim 3, wherein said reflecting surface of said reflector is provided with a horizontally deflective reflection zone which horizontally deflects and reflects light that has traveled from said filament past upper edges of said shade and impinged on an oncoming-lane-side reflection zone of said reflecting surface; and wherein said horizontally deflective reflection zone forms a long-distance radiation light distribution pattern wherein oncoming-lane-side ends are located substantially on a vertical line perpendicular to a lighting fixture reference axis.

7. The vehicular headlamp according to claim 3, wherein a plurality of lens elements are formed in a predetermined zone of said front lens.

8. The vehicular headlamp according to claim 4, wherein a plurality of lens elements are formed in a predetermined zone of said front lens.

9. A vehicular headlamp comprising:

a light source bulb having a longitudinally extending filament and a shade covering a bottom area of said filament around a longitudinal axis of said filament at a central angle of approximately 165° so that light travelling downward from said filament is blocked;

a reflector supporting the light source bulb and having a reflecting surface forwardly reflecting light from said filament; and a front lens disposed forwardly of the reflector, said light source bulb being supported by said reflector so that left and right upper edges of said shade are at substantially the same height and said longitudinal axis of said filament is upwardly offset from an optical axis of said reflector at a predetermined angle; and said front lens being provided with a downward deflective transmission zone which downwardly deflects and transmits light that has traveled from said filament past upper edges of said shade and impinged on a traveling-lane-side reflection zone of said reflecting surface.

10. The vehicular headlamp according to claim 9, wherein said downward deflective transmission zone comprises a plurality of downward deflection lens elements having respective different downward deflection angles.

11. The vehicular headlamp according to claim 9, wherein said front lens is provided with a horizontally deflective transmission zone which horizontally deflects and transmits light that has traveled from said filament past said upper edges of said shade and been reflected by an oncoming-lane-side reflection zone of said reflecting surface; and wherein said horizontally deflective transmission zone forms a long-distance radiation light distribution pattern wherein oncoming-lane-side ends are located substantially on a vertical line perpendicular to a lighting fixture reference axis.

12. The vehicular headlamp according to claim 10, wherein said front lens is provided with a horizontally deflective transmission zone which horizontally deflects and transmits light that has traveled from said filament past upper edges of said shade and been reflected by on an oncoming-lane-side reflection zone of said reflecting surface; and wherein said horizontally deflective transmission zone forms a long-distance radiation light distribution pattern wherein oncoming-lane-side ends are located substantially on a vertical line perpendicular to a lighting fixture reference axis.

* * * * *